US007757744B2

(12) United States Patent
Hirata et al.

(10) Patent No.: US 7,757,744 B2
(45) **Date of Patent: *Jul. 20, 2010**

(54) METHOD OF CHANGING A MATCH PLATE IN A FLASKLESS MOLDING APPARATUS FOR AN UPPER MOLD AND A LOWER MOLD

(75) Inventors: Minoru Hirata, Toyokawa (JP); Takayuki Komiyama, Toyokawa (JP)

(73) Assignee: Sintokogio, Ltd., Aichi (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/919,909

(22) PCT Filed: Apr. 28, 2006

(86) PCT No.: PCT/JP2006/309046

§ 371 (c)(1),
(2), (4) Date: Nov. 5, 2007

(87) PCT Pub. No.: WO2006/120948

PCT Pub. Date: Nov. 16, 2006

(65) Prior Publication Data

US 2009/0020255 A1 Jan. 22, 2009

(30) Foreign Application Priority Data

May 6, 2005 (JP) ..... 2005-134702

(51) Int. Cl.
*B22C 9/00* (2006.01)
*B22C 15/02* (2006.01)
*B22C 15/24* (2006.01)

(52) U.S. Cl. ..... 164/20; 164/29; 164/184; 164/194; 164/201

(58) Field of Classification Search ..... 164/88–22, 164/180–184, 194, 200–202, 214, 322, 29
See application file for complete search history.

(56) References Cited

U.S. PATENT DOCUMENTS 3,589,432 A * 6/1971 Miller et al. ..... 164/182

(Continued)

FOREIGN PATENT DOCUMENTS

| | | |
|---|---|---|
| EP | 0 468 355 A2 | 1/1992 |
| EP | 1 208 928 A1 | 5/2002 |
| JP | 62-16736 | 2/1981 |
| JP | 56-119645 | 9/1981 |
| JP | 3243243 | 10/1991 |
| WO | WO 00/50187 A | 8/2000 |

OTHER PUBLICATIONS

Office Action of Feb. 27, 2009 in U.S. Appl. No. 10/582,965.

*Primary Examiner*—Kuang Lin
(74) *Attorney, Agent, or Firm*—Finnegan, Henderson, Farabow, Garrett & Dunner, L.L.P.

(57) ABSTRACT

This invention provides a method for changing a match plate in a molding apparatus for a flaskless upper mold and a lower mold, which method allows easy change of the match plate.

Figure 1:
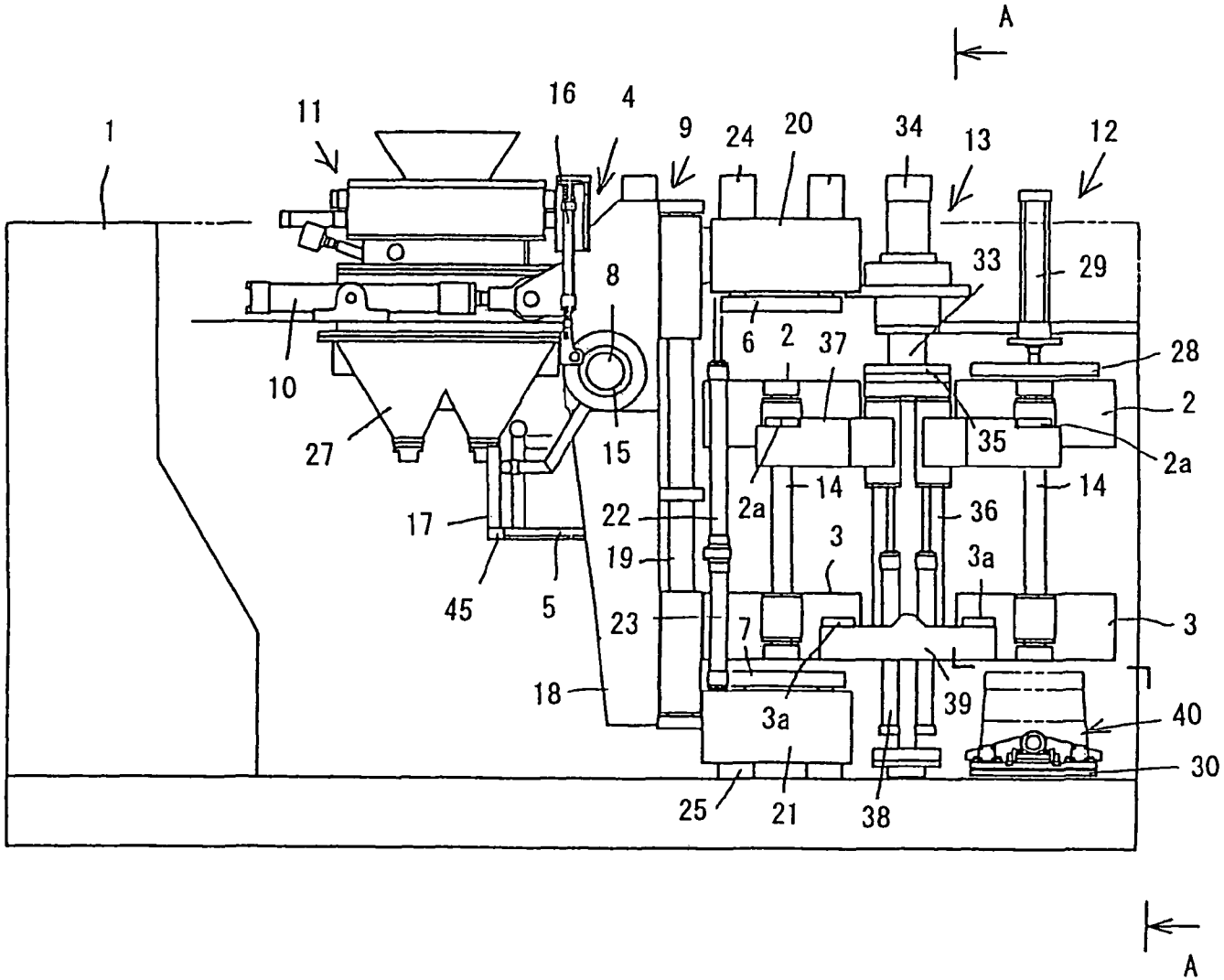

This invention is comprised of a first step for moving a existing match plate placed in the apparatus to between a cope flask and a drag flask of one set of flasks in the perpendicular position, and for holding a new match plate between a cope flask and a drag flask of another set of flasks in the horizontal position, a second step for rotating the cope flask and the drag flask holding said existing match plate from the perpendicular position to the horizontal position, and for rotating the other cope flask and the drag flask holding the new match plate from the horizontal position to the perpendicular position, and a third step for moving the new match plate from the perpendicular position to the apparatus, and for moving the existing match plate from the horizontal position to the outside of the apparatus.

1 Claim, 6 Drawing Sheets

U.S. PATENT DOCUMENTS 4,463,794 A 8/1984 Shioda
4,541,476 A * 9/1985 Larsen ..... 164/182
4,791,974 A 12/1988 Larsen
5,246,058 A 9/1993 Murata
6,470,953 B1 10/2002 Hirata et al.
6,499,531 B1 * 12/2002 Knudsen ..... 164/211

* cited by examiner

METHOD OF CHANGING A MATCH PLATE IN A FLASKLESS MOLDING APPARATUS FOR AN UPPER MOLD AND A LOWER MOLD

TECHNICAL FIELD

This invention relates to a method of changing a match plate in a flaskless molding apparatus for an upper mold and a lower mold.

BACKGROUND OF THE INVENTION

Conventionally, as one of the molding machines of this type, there is the following apparatus, comprising:

a first station, which is disposed above a base, for compressing molding sand in a molding space by squeezing the sand in horizontally, a second station, which is disposed near the lower surface of the base, for matching perpendicularly an upper mold with a lower mold against the lower surface of the base and for stripping flasks, wherein two sets of the cope flask and the drag flask are alternately reciprocated between the first and the second station, and wherein a flaskless upper mold and a lower mold that are stacked are produced.

Patent document 1: Examined Japanese Patent Application Publication No. S62-16736

DISCLOSURE OF INVENTION

However, for the conventional molding apparatus for a flaskless upper mold and a lower mold that has the constitution as explained in the above paragraphs, there is a problem in that the match plate used for the apparatus cannot be easily changed.

These following inventions intend to solve the above problem and provide a method of changing a match plate in a molding apparatus for a flaskless upper mold and a lower mold that allows the apparatus to easily change it.

To achieve the purpose explained in the above paragraph, the inventions according to the method for changing match plates is constituted of:

a method for changing a match plate in a molding apparatus for a flaskless upper mold and a lower mold, wherein the apparatus is comprised of a squeezing mechanism that can alternately move each of two sets of a cope flask and a drag flask between a perpendicular position and a horizontal position, and a rotating mechanism that can rotate the two sets of the cope flask and the drag flask, wherein the each set of the cope flask and the drag flask defines main parts of an upper and a lower molding space by holding a match plate between the cope flask and the drag flask at the perpendicular position, wherein the molds in the upper and the lower molding space can be stripped at the horizontal position, the method comprising:

a first step for moving a match plate placed in the apparatus to a place between a cope flask and a drag flask of one set of flasks disposed at the rotating mechanism, and for holding horizontally a new match plate between a cope flask and a drag flask of another set of flasks disposed horizontally at the rotating mechanism, a second step for moving the set of the cope flask and the drag flask holding said match plate from within the squeezing mechanism to the outside of the squeezing mechanism, and simultaneously the other set of the cope flask and the drag flask holding said new match plate from outside the squeezing mechanism to within the squeezing mechanism, by the rotation of the rotating mechanism, and, a third step for passing the other set of the cope flask and the drag flask holding said new match plate to the squeezing mechanism, and for removing said match plate between the cope flask and the drag flask of the set disposed at the rotating mechanism.

Since this invention includes the following technical features:

a method for changing match plates in a molding apparatus for a flaskless upper mold and a lower mold, wherein the apparatus is comprised of a squeezing mechanism that can alternately move each of two sets of a cope flask and a drag flask between a perpendicular position and a horizontal position, and a rotating mechanism that can rotate the two sets of the cope flask and the drag flask, wherein each set of the cope flask and the drag flask defines main parts of an upper and a lower molding space by holding a match plate between the cope flask and the drag flask at the perpendicular position, wherein the molds in the upper and the lower molding space can be stripped at the horizontal position, the method comprising:

a first step for moving a match plate placed in the apparatus to a place between a cope flask and a drag flask of one set of flasks disposed at the rotating mechanism, and for holding the new match plate between a cope flask and a drag flask of another set of flasks disposed horizontally at the rotating mechanism, a second step for moving the set of the cope flask and the drag flask holding said match plate from within the squeezing mechanism to the outside of the squeezing mechanism, and simultaneously the other set of the cope flask and the drag flask holding said new match plate from outside the squeezing mechanism to within the squeezing mechanism, by the rotation of the rotating mechanism, and a third step for passing the other set of the cope flask and the drag flask holding said new match plate to the squeezing mechanism, and for removing said match plate between the cope flask and the drag flask of the set disposed at the rotating mechanism, the match plates can be rapidly and efficiently changed by this method. Namely, this invention can achieve an excellent effect in practical use.

BRIEF DESCRIPTIONS OF THE DRAWINGS

FIG. 1 is an elevational view and a partial sectional view of the apparatus for molding a mold of the preferred embodiment of the invention.

Figure 2:
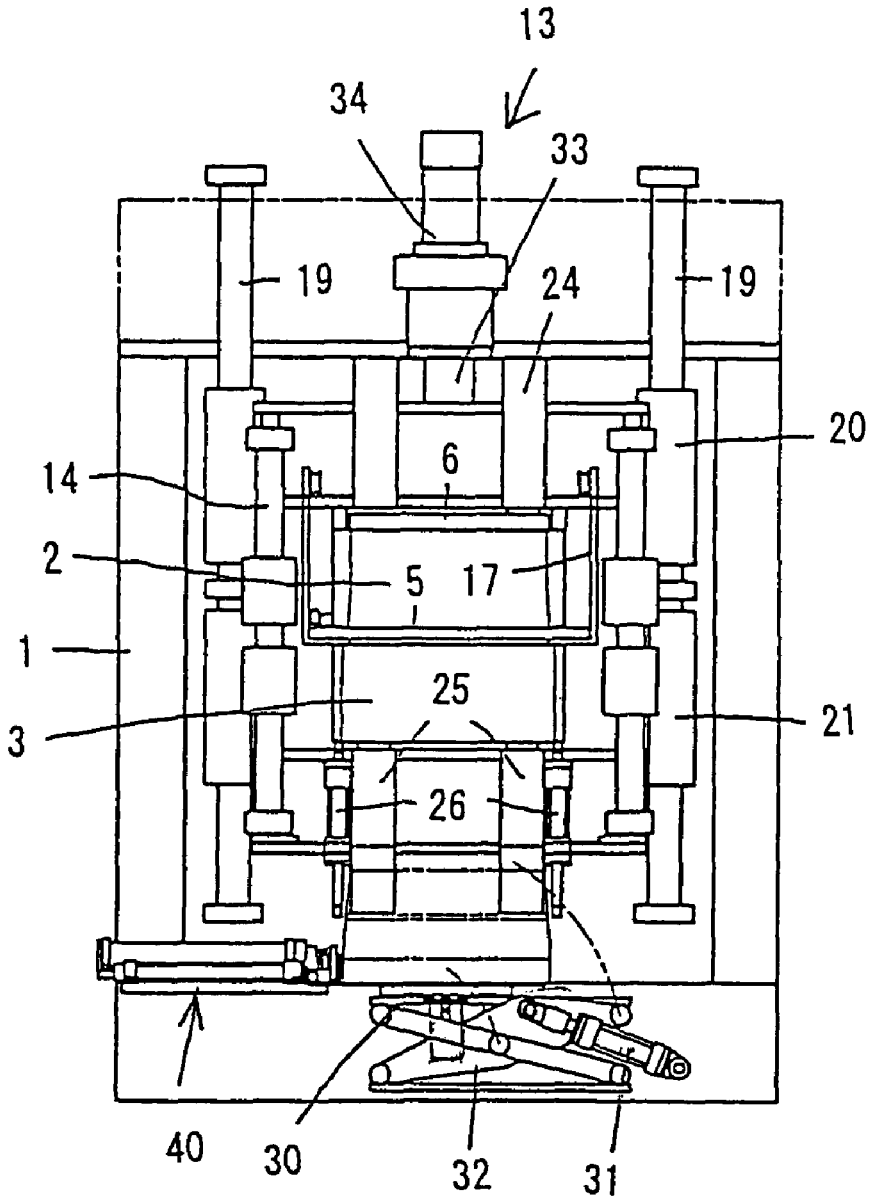

FIG. 2 shows an A-A section of FIG. 1, and the condition of holding the match plate 5 between the cope flask 2 and the drag flask 3.

Figure 3:
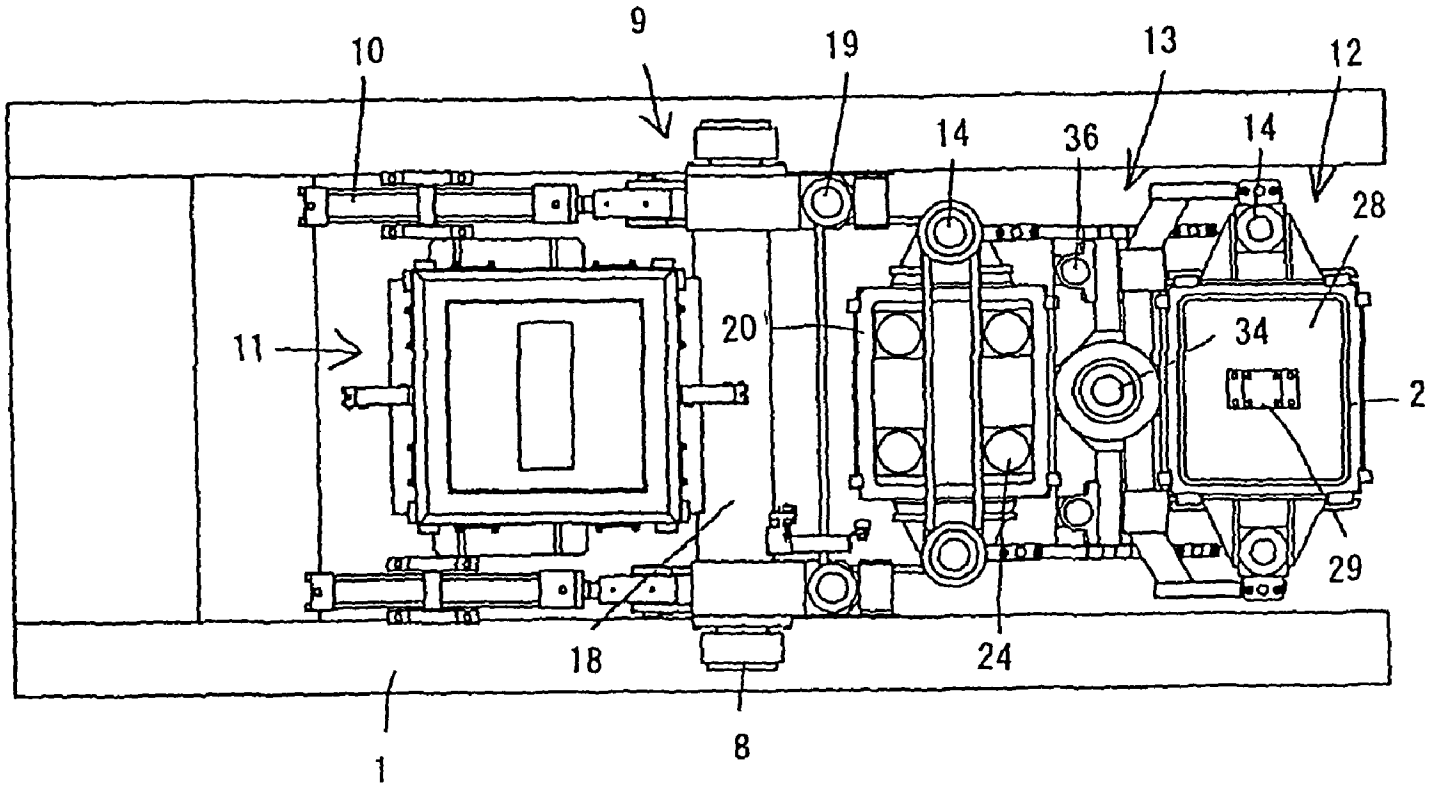

FIG. 3 shows a plane view of FIG. 1.

Figure 4:
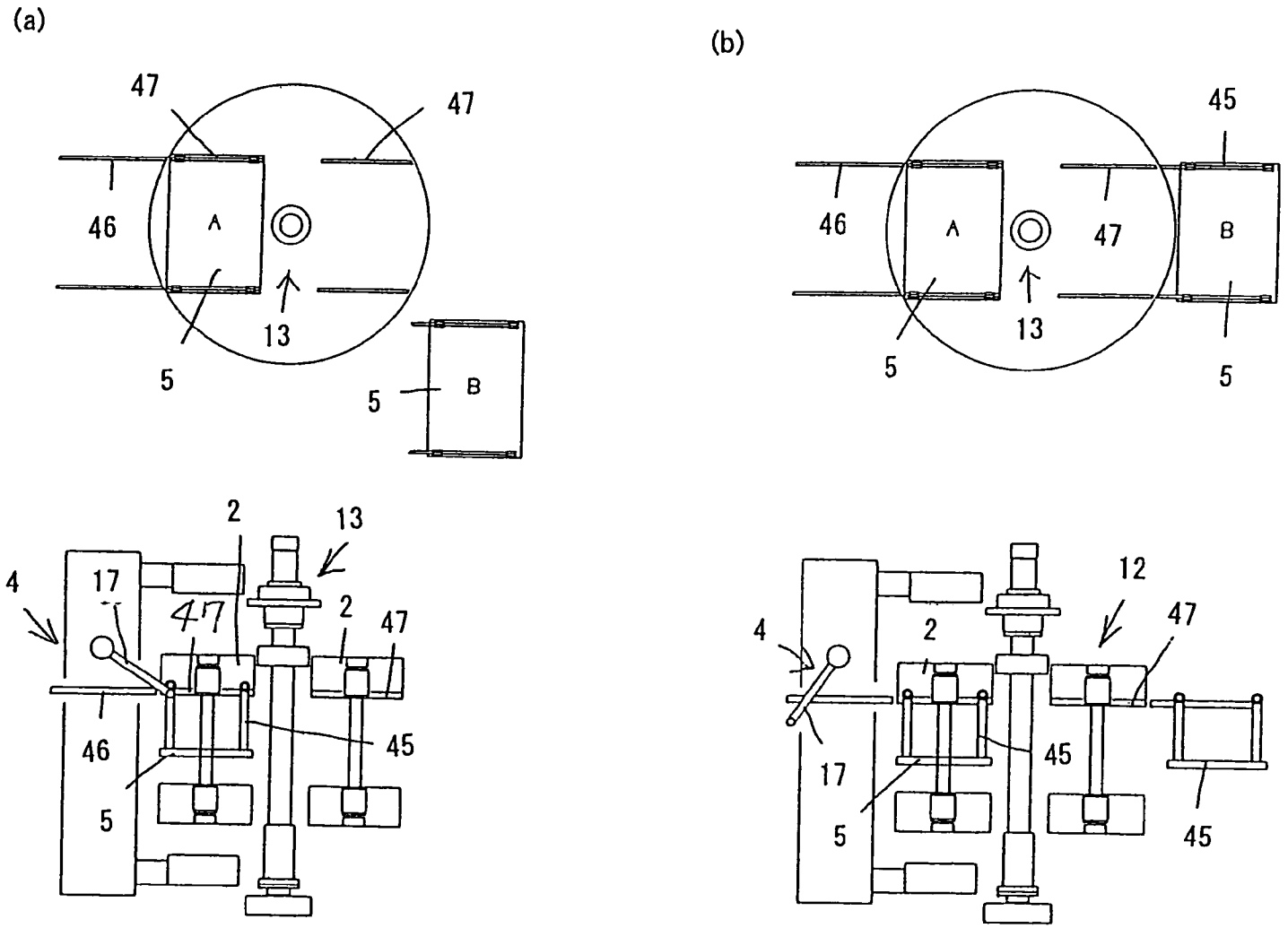

FIG. 4(*a*) is an explanatory drawing of some of the processes for changing a match plate using the apparatus shown in FIG. 1. This drawing consists of a plane view shown in the upper part and an elevational view shown in the lower part of FIG. 4(*a*). FIG. 4(*b*) is an explanatory drawing showing some of the processes for changing a match plate using the apparatus shown in FIG. 1. FIG. 4(*b*) consists of a plane view shown in the upper part and an elevational view shown in the lower part.

Figure 5:
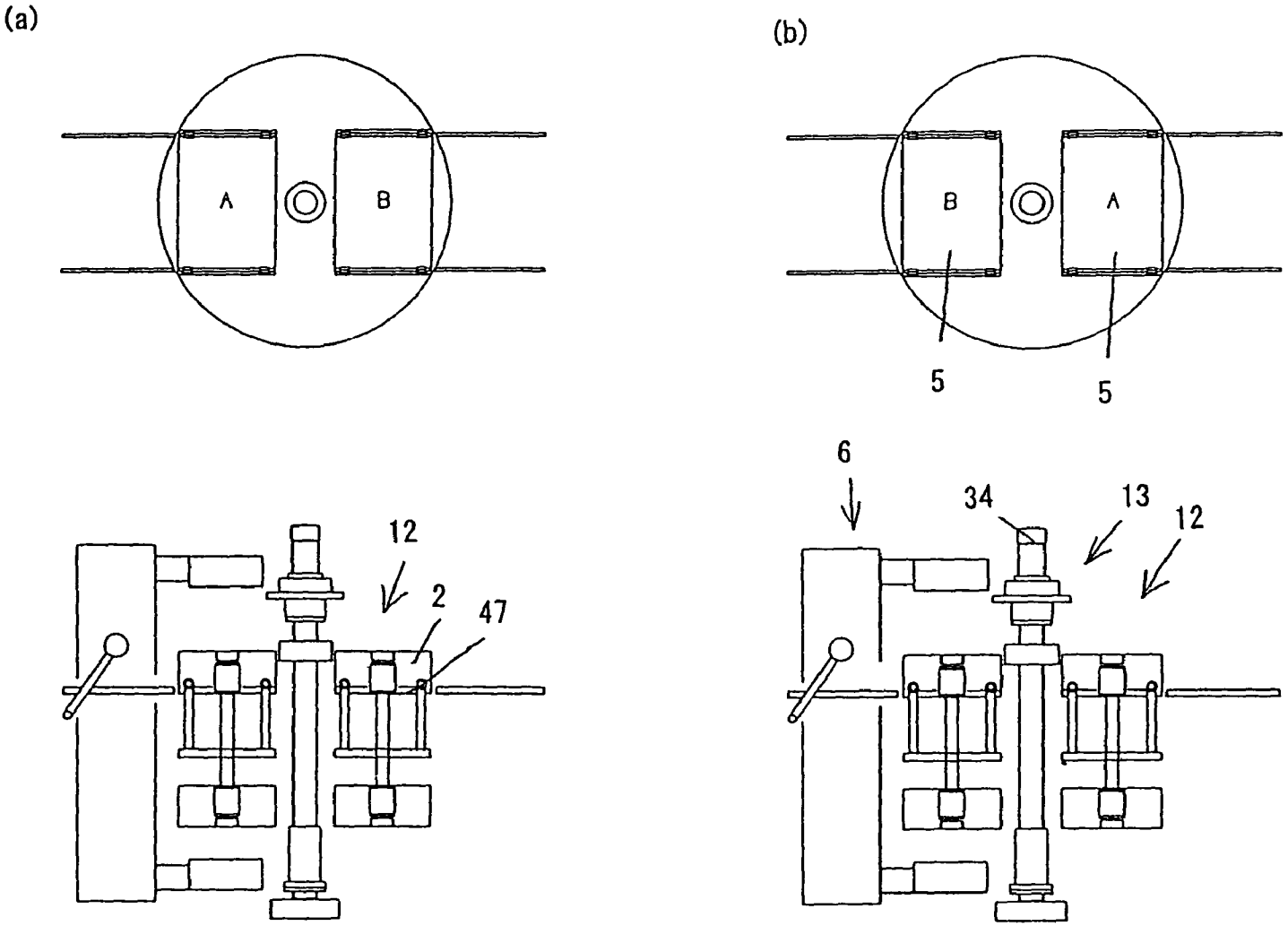
Figure 6:
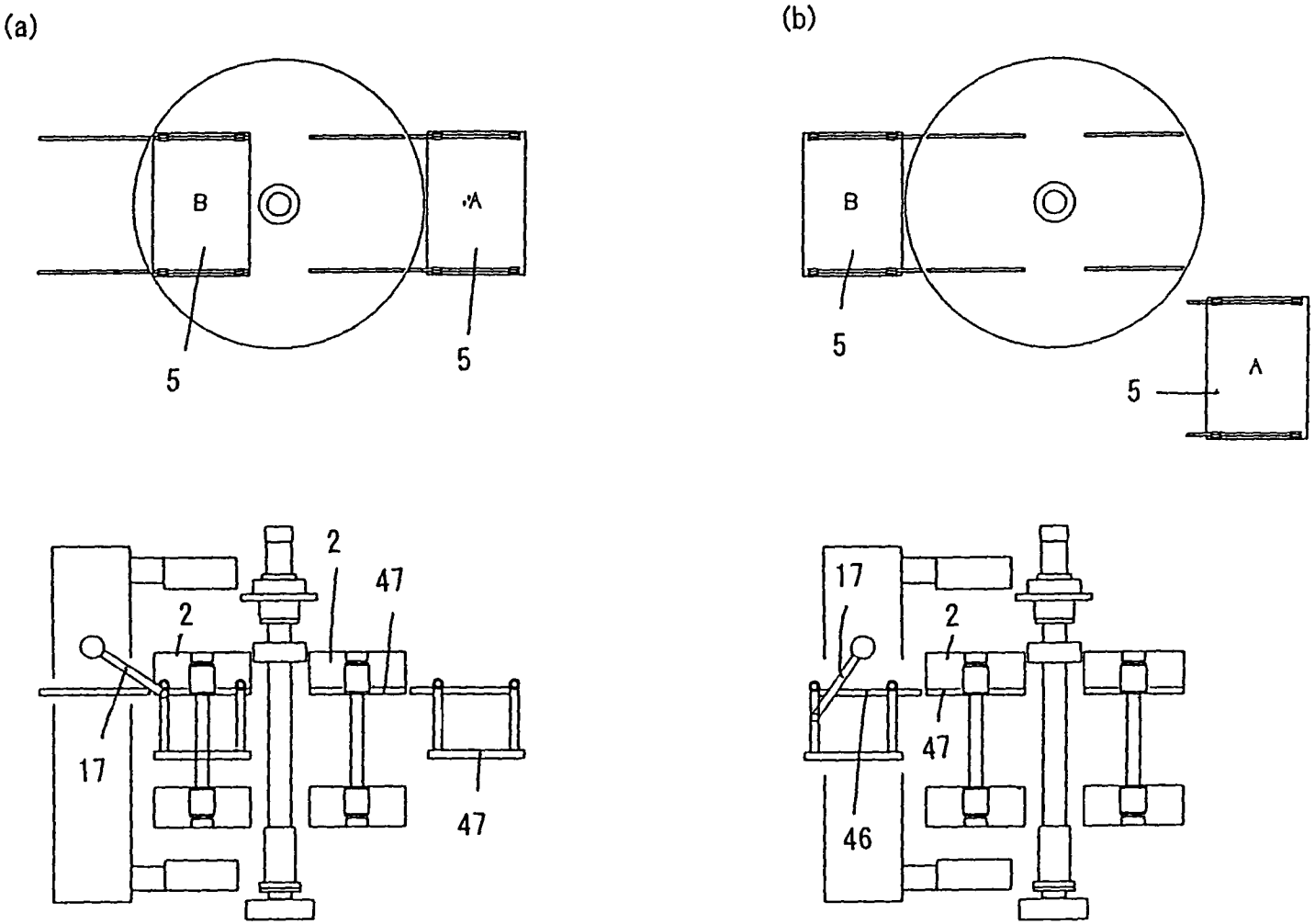

FIG. 5(*a*) is an explanatory drawing of some of the processes for changing a match plate using the apparatus shown in FIG. 1. This drawing consists of a plane view shown in the upper part and an elevational view shown in the lower part of FIG. 5(*a*). FIG. 5(*b*) is an explanatory drawing showing some of the processes for changing a match plate using the apparatus shown in FIG. 1. FIG. 5(*b*) consists of a plane view shown in the upper part and an elevational view shown in the lower part FIG. 6(*a*) is an explanatory drawing of some of the processes for changing a match plate using the apparatus shown in FIG. 1. This drawing consists of a plane view shown in the upper part and an elevational view shown in the lower part of FIG. 6(*a*). FIG. 6(*b*) is an explanatory drawing showing some of the processes for changing a match plate using the apparatus shown in FIG. 1. FIG. 6(*b*) consists of a plane view shown in the upper part and an elevational view shown in the lower part.

PREFERRED EMBODIMENTS OF THE INVENTION

An embodiment of the molding apparatus for a flaskless upper mold and lower mold of this invention is now explained in detail based on FIGS. 1-6.

As shown in FIGS. 1-3, a molding apparatus for a flaskless upper mold and a lower mold is comprised of:

a base 1 having an internal space and a rectangular parallelepiped configuration, two pairs of a cope flask 2,2 and a drag flask 3,3 having sand-filling ports at their side walls, a match plate 5 which can be inserted and taken out between one of the two pairs of the cope flask 2, 2 and the drag flask 3, 3 by a conveying apparatus 4, a squeezing mechanism 9 to squeeze the molding sand, which mechanism 9 supports a pair of the cope flask 2 and the drag flask 3 holding the match plate 5 therebetween, and supports the upper and the lower squeeze plates 6, 7, which act as the squeeze means and are insertable into the openings of the cope flask and the drag flask, which openings are opposed to the match plate 5, and which mechanism 9 can rotate clockwise or counterclockwise in a perpendicular plane about a supporting shaft 8 disposed on the base 1 so that the pair of the cope flask 2 and the drag flask 3 holding the match plate 5 therebetween can be placed at both the perpendicular and horizontal positions, a transverse cylinder 10 as a driving mechanism to rotate the squeezing mechanism 9 clockwise or counterclockwise, a sand-supply mechanism 11 to fill the molding sand into the cope flask and the drag flask 2, 3, which are perpendicular, by extending motion of the cylinder 10, through the sand-filling ports of the cope flask and the drag flask, a stripping mechanism 12 to strip an upper mold and a lower mold from the pair of the cope flask 2 and the drag flask 3 containing a mold, which are in a stacked relationship and are horizontal, and a rotating mechanism 13 to alternately and intermittently rotate the two pairs of the cope flask 2 and the drag flask 3, which are horizontal, between the squeezing mechanism 9, wherein cope flask 2 and drag flask 3 are horizontal, and the stripping mechanism 12, and to lift and lower the cope flask 2.

In the cope flask 2 and the drag flask 3, a pair of connecting rods 14, 14 is hung from the front and the rear outer surface of the cope flask 2, and the drag flask 3 is slidably connected to the connecting rods 14, 14, as shown in FIG. 1. The drag flask 3 is stopped at the lower end of the connecting rods 14, 14. Further, protuberances 2*a*, 2*a*, 3*a*, 3*a* are disposed at the center of the front and the rear outer surface of the cope flask 2 and at the right side of the front and the rear outer surface of the drag flask 3 in the state wherein the drag flask 3 is positioned on the squeezing mechanism 9.

The conveying apparatus 4 for carrying the match plate 5 includes:

a ring member 15 disposed on the surface of the supporting shaft 8 of the squeezing mechanism 9, a cylinder 16 connected to the sand-supplying mechanism 11 at its base end and rotatably connected to the portion of the ring member 15 at the distal end of the piston rod of the cylinder 16, a pair of arms 17, 17 fixed to the ring member 15 at its end as a cantilevered structure, and a carrier plate 45 hung so as to be able to hold the match plate 5 and reciprocate from side to side, as shown in FIG. 1.

The pair of the arms 17, 17 rotate by means of the telescopic movement of the cylinder 16. Then the carrier plate 45 can insert the match plate 5 between the pair of the cope flask 2 and the drag flask 3 on the squeezing mechanism 9, which is horizontal, and can remove the match plate 5 from them through rails 46, 47, 47, explained below. (See FIGS. 4-6.) By rotating the arms 17, 17 and by the telescopic movement of the cylinder 16, while carrier plate 45 descends a small distance through the cope flask 2, the arms 17, 17 can be connected to or disconnected from the carrier plate 45.

In the squeeze mechanism 9, as shown in FIG. 1, a central portion of a rotating frame 18 is disposed at the supporting shaft 8 disposed at the upper portion and the central portion of the base 1 so that the rotating frame 18 can rotate clockwise or counterclockwise in the perpendicular plane.

A pair of guide rods 19, 19, extending vertically, are disposed at the right side of the rotating frame 18 with a set interval in the direction connecting the front and back sides of the rotating frame 18.

An upper lifting and lowering frame 20, having a reverse L-shaped configuration, is slidably disposed at the upper portion of the guide rods 19, 19 through a holder portion fixed to the lifting and lowering frame 20. Also, a lower lifting and lowering frame 21, having a L-shaped configuration, is slidably disposed at the lower portion of the guide rods 19, 19 through a holder portion fixed to the lifting and lowering frame 21.

The upper and the lower lifting and lowering frame 20, 21 can be approached and separated from each other by means of a cylinder 22 arranged upward and a cylinder 23 arranged downward.

Rails 46 are fixed to the rotating frame 18 so that when the pair of the cope flask and the drag flask are horizontal, the carrier plate 45 can be guided.

Rails 47 for guiding the carrier plate 45 are disposed at the cope flasks 2, 2 and reach the same level as the rails 46 when the cope flasks 2, 2 move upward. (See FIGS. 4-6.)

A plurality of the cylinders 24, 24 to move the squeeze plate 6 forward or backward are disposed at the upper lifting and lowering frame 20.

Also, a plurality of the cylinders 25, 25 to move the squeeze plate 7 forward or backward are disposed at the lower lifting and lowering frame 21.

The upper and the lower lifting and lowering frame 20, 21 each have a large and horizontal flat surface so as to push the cope flask 2 and the drag flask 3.

The sand-supplying mechanism 11 is disposed at the upper-left side portion of the base 1, and is comprised of two aeration tanks 27, 27.

The sand-supplying mechanism 11 can fill the molding sand into the cope flask and the drag flask independently by means of low-pressure air (filling the molding sand by aeration).

An air pressure of 0.05 Mpa-0.18 Mpa is preferable to aerate the molding sand. Further, vacuum pressure can be used to aerate the molding sand by having the aeration tanks communicate with the vacuum pressure source (not shown).

The aeration tanks 27, 27 may be operated at the same time by controlling them simultaneously by one or two controllers.

In the stripping mechanism 12, a pushing member 28 is fixed at the distal end of the piston rod of the cylinder 29 which is arranged downward and fixed to the upper portion of the base 1. A pushing member 28 can be inserted in the cope flask 2 and the drag flask 3, which are stacked and are horizontal, and can move up and down by the telescopic motion of the cylinder 29.

A receiving member 30 is disposed below the pushing member 28. The receiving member 30 supports the upper mold and the lower mold that are stripped from the cope flask 2 and the drag flask 3. The receiving member 30 can move up and down by a pantograph mechanism 32 driven by the telescopic motion of a cylinder 31.

Namely, since the pantograph mechanism is used to move the receiving member 30, it is unnecessary to provide a pit for the stripping mechanism 12. (See FIG. 2.)

In the rotating mechanism 13, a rotating shaft 33, extending upward and downward, is rotatably disposed at the base 1. The distal end of the rotating shaft 33 is connected to an output shaft of a motor 34 fixed to the upper end of the base 1. The rotating shaft 33 can be rotated clockwise or counterclockwise by 180 degrees by the motor 34.

A supporting member 35 is disposed at the top of the rotating shaft 33. Two pairs of guide rods 36, 36 extending downward are hung from the supporting member 35 with a set interval in the direction connecting the front and the back side of the rotating mechanism 13.

Two pairs of the guide rods 36, 36 are symmetrically located about the rotating shaft 33.

Upper hooks 37 for hooking the protuberances 2*a*, 2*a* of the cope flask 2 are slidably disposed at each of the two pairs of the guide rods 36, 36.

The hooks 37 are fixed to the distal end of the piston rod of a cylinder 38 arranged vertically and connected to the rotating shaft 33. The hooks 37 can move up and down by means of the cylinder 38.

Lower hooks 39 for hooking the protuberances 3*a*, 3*a* of the drag flask 3 are fixed at the lower ends of the two pairs of the guide rods 36, 36.

A symbol 40, shown in the figures, denotes an apparatus for pushing out the upper mold and the lower mold that are stripped from the cope flask 2 and the drag flask 3 from the receiving member 30.

Next, the processes for changing the match plates in the apparatus for molding the flaskless molds are explained in detail.

As shown in FIG. 4(*a*), after lifting the cope flasks 2, 2 on the upper hooks 37,37 by extending motion of the cylinders 38, 38 of the rotating mechanism 13, the carrier plate 45, having the existing match plate 5(A) on it, is transferred from the rails 46 to the rails 47 of the cope flask 2 by extending motion of the cylinder 16 of the conveying apparatus 4 so that a pair of the arms 17, 17 rotate counterclockwise. Thus the match plate 5(A) is transferred to the cope flask 2, located at the left side.

Next, as shown in FIG. 4(*b*), while the cope flask 2 is being moved slightly up and down by driving the cylinder 38, the pair of the arms 17, 17 are released from the carrier plate 45 by contracting the cylinder 16 of the conveying apparatus 4 so that the pair of the arms 17, 17 can rotate clockwise and can be returned to the initial position. Further, the carrier plate 45, having the new match plate 5(B) on it, which carrier plate 45 is hung from the rails disposed at an appropriate transfer means, and which carrier plate 45 is waiting at the side of the stripping mechanism 12, moves to the position that is opposed to the rails 47 of the cope flask 2, which cope flask 2 is at the right side of the apparatus, and which cope flask 2 is located within the stripping mechanism 12.

Next, as shown in FIG. 5(*a*), the carrier plate 45, which is disposed at the position that is opposed to the rails 47 of the cope flask 2, which cope flask 2 is located at the right side of the apparatus and within the stripping mechanism 12, is manually moved on the rails 47. Thus new match plate 5(B) is transferred to the cope flask 2, located at the right side. Then the match plate 5(B), which is positioned at the right side of the apparatus and within the stripping mechanism 12, is rotated and moved to the squeezing mechanism 9, and simultaneously the match plate 5(A), which is positioned at the left side of the apparatus and within the squeezing mechanism 9, is rotated and moved to the stripping mechanism 12 by driving the motor 34 of the rotating mechanism 13, as shown in FIG. 5(*b*).

Then, as shown in FIG. 6(*a*), a pair of the arms 17, 17 are connected to the carrier plate 45 having the match plate 5(B) on it by extending the cylinder 16 so that the pair of the arms 17, 17 can rotate counterclockwise, while the cope flask 2 is being moved up and down for a short distance by the telescopic motion of the cylinder 38.

Next, as shown in FIG. 6(*b*), the carrier plate 45, having the match plate 5(A) on it, is moved from the rails 47 of the cope flask 2 to the outside of the apparatus. The carrier plate 45, having the match plate 5(B), is then moved from the rails 47 of the cope flask 2 to the rails 46 by contracting the cylinder, 16 of the conveying apparatus 4 so that the pair of the arms 17, 17 can rotate clockwise. Thus the match plate 5(B) is transferred from the cope flask 2. The carrier plate 45, having the match plate 5(A), and having been removed from the rails 47, is moved to an appropriate place by an appropriate transfer means. Consequently, the process for changing the match plate 5 is then completed.

What is claimed is:

1. A method for changing a match plate used in an apparatus for molding a flaskless upper mold and a lower mold that are in a stacked relationship, wherein the apparatus includes:

a squeezing mechanism to squeeze molding sand by an upper and a lower squeeze means, which mechanism supports a pair of a cope flask and a drag flask holding the match plate therebetween, which mechanism can clockwise or counterclockwise rotate the pair of the cope and the drag flask in a perpendicular plane about a supporting shaft so that the pair can be positioned perpendicularly or horizontally, wherein the upper and the lower squeeze means are insertable into the openings of the cope flask and the drag flask, which openings are opposed to the match plate, and wherein the upper and the lower squeeze means include an upper and a lower squeeze plate, respectively;

a stripping mechanism to strip an upper mold and a lower mold from a pair of the cope flask and drag flask containing a mold which are in a stacked relationship and are in a horizontal position; and a rotating mechanism to alternately and intermittently rotate two pairs of a cope flask and the drag flask, between the squeezing mechanism, where the cope flask and the drag flask are in a horizontal position, and the stripping mechanism, which rotating mechanism includes means for lifting and lowering the cope flask, wherein the method for changing the match plate from an existing match plate to a new match plate using the rotating mechanism having the two pairs of the cope flask and the drag flask, comprises:

lifting the two cope flasks of the two pairs of the cope flask and the drag flask;

moving a first carrier plate on rails of a first cope flask of a first pair of a cope and a drag flask positioned at the squeezing mechanism, where the first carrier plate holds the existing match plate, to insert the existing match plate between the first pair of the cope and drag flask, moving a second carrier plate on rails of a second cope flask of a second pair of the cope and drag flask positioned at the stripping mechanism, where the second carrier plate holds the new match plate, to insert the new match plate between the second pair of the cope and drag flask, moving the first pair of the cope and drag flask positioned at the squeezing mechanism and the first carrier plate having the existing match plate to the stripping mechanism, and of simultaneously moving the second pair of the cope flask and drag flask positioned at the stripping mechanism and the second carrier plate having the new match plate to the squeezing mechanism with the rotating mechanism; and moving the first carrier plate having the existing match plate from the rails of the first cope flask now positioned at the stripping mechanism so that the existing match plate can be removed from the apparatus, and of moving the second carrier plate having the new match plate from the rails of the second cope flask now positioned at the squeezing mechanism so that the new match plate can now be used in the apparatus.

* * * * *